United States Patent [19]

Eng

[11] 4,375,325

[45] Mar. 1, 1983

[54] MACHINE FOR DEVELOPMENT OF EXPOSED PICTURES

[76] Inventor: Olov Eng, Pl. 8362, Borås, Sweden, 505 90

[21] Appl. No.: 252,444

[22] PCT Filed: Aug. 10, 1979

[86] PCT No.: PCT/SE79/00169

§ 371 Date: Apr. 9, 1981

§ 102(e) Date: Apr. 9, 1981

[87] PCT Pub. No.: WO81/00465

PCT Pub. Date: Feb. 19, 1981

[51] Int. Cl.[3] ..... G03D 5/06

[52] U.S. Cl. ..... 354/318; 354/319

[58] Field of Search ..... 354/317, 318, 319

[56] References Cited

U.S. PATENT DOCUMENTS

| | | | |
|---|---|---|---|
| 3,453,944 | 7/1969 | Eng | 354/317 |
| 3,575,101 | 4/1971 | Smith et al. | 354/318 |
| 3,682,079 | 8/1972 | Casson | 354/319 |

*Primary Examiner*—L. T. Hix
*Assistant Examiner*—Alan Mathews
*Attorney, Agent, or Firm*—Holman & Stern

[57] ABSTRACT

A machine for developing exposed pictures comprising a plurality of receptacles for different processing liquids, a cylinder arranged in each receptacle and arranged to be partly immersed in the liquid and to be rotated to carry a layer of such processing liquid on its envelope surface, a transport device arranged to transfer a series of pictures to be developed in contact with the liquid layers on said cylinders the direction of transfer of said pictures thereby being perpendicular to the direction of rotation of said cylinders.

3 Claims, 5 Drawing Figures

MACHINE FOR DEVELOPMENT OF EXPOSED PICTURES

BACKGROUND OF THE INVENTION

1. Field of the Invention

The invention refers to a machine for development of exposed pictures.

A number of different more or less automatized machines, which are all expensive to obtain and service and which are also difficult to clean have earlier been proposed for such development of exposed pictures.

2. Description of the Prior Art

Thus, there are machines, which comprise a tub through which the items to be developed are transferred and to which tub the different liquids necessary for the development process are supplied alternately. An advantage of this type of machine is that its dimension can be rather small, but it gives at the same time the drawback that the different liquids have to be introduced into and to be removed from the process tub between each stage of the development. In other types of machines the process tub has been subdivided into different receptacles, in which the different liquids have been contained constantly. In order to be able to transfer the objects to be developed through the liquid in a suitable manner it has thereby been necessary to use a comparatively large quantity of liquid and to allow the pictures to move in this liquid over a cylinder or the like. As most of the process liquids are rather expensive this is a clear drawback and the need of energy for maintaining the present liquid quantity at a correct temperature will furthermore increase. A further drawback with the pictures being transferred through the liquids is the risk of contamination of a liquid with the previously used liquid at the same time as the immersion of the pictures in the liquid means that the entire paper, i.e. also the surface which has no emulsion, will be wet by the liquids in question, which means an increased drying time. A drawback common for earlier known developing machines of this kind is also that the separate parts thereof are so difficult to reach that the possibilities of cleaning the machine are extremely limited.

SUMMARY OF THE INVENTION

The purpose of the invention is to provide a machine for development of exposed pictures and of the type incorporating a tank, which is subdivided into a plurality of receptacles which are sealed off from each other and intended to contain required process liquids, and in which each receptacle is provided with a cylinder, which is rotatable about a mainly horizontal axis of rotation, which cylinders are adapted to be partly immersed in the liquid in its associated receptacle and to effect during its rotation a contact between the pictures to be developed and the different liquids in the intended order, and which machine is comparatively inexpensive to manufacture and to service at the same time as it to a high extent eliminates the drawbacks mentioned hereabove.

This is according to the invention achieved in that said receptacles are arranged in a continuous row with said cylinders arranged with their axes of rotation along a common straight line, whereby means are arranged for continuously transferring the pictures to be developed in a path perpendicular to the cylinder's direction of rotation along a portion of each cylinder situated above the liquid level in each receptacle and preferably diametrically opposite the portion of the cylinder immersed in the liquid, whereby the pictures in proper order will contact the liquid layer which each cylinder during its rotation will carry to its said portion above the liquid level.

BRIEF DESCRIPTION OF THE DRAWINGS

The invention will hereinafter be further described with reference to some embodiments of the invention shown in the accompanying drawings, wherein.

DESCRIPTION OF SOME PREFERRED EMBODIMENTS

Figure 1:
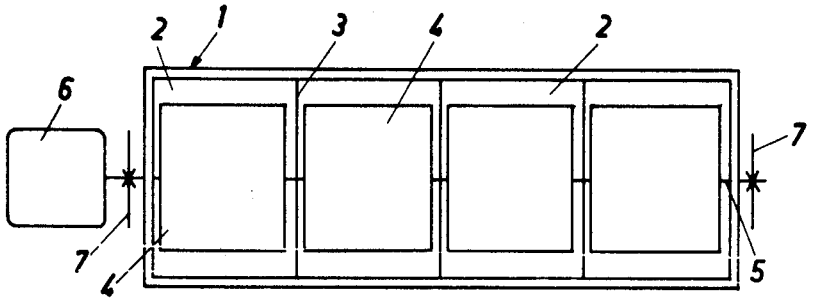
FIG. 1 shows in a schematic planar view from above the tank with the driving device forming part of the development machine according to the invention.

In FIG. 1 there is shown in a view from above a tank 1, which is subdivided into a plurality of smaller tanks or receptacles 2, which are defined by the tank walls and by movable partition walls 3, which can be inserted in a leak-proof manner in optional positions along the tank length and perpendicularly thereto. The receptacles 2 are each one provided with a cylinder 4 arranged therein and these cylinders are rotatable with a shaft 5, which is preferably common for all cylinders and which is driven by a driving device 6, which e.g. could be an electric motor. The shaft is supported in bearings 7 at suitable positions and the shaft portions associated with each cylinder are preferably exchangeable by aid of devices (not shown), whereby it is possible by moving one or more partition walls 3 from one to another position and by exchange of one or more cylinders 4 with other cylinders of bigger or smaller length to bring about an adjustment of the process time for each receptacle in the tank 1.

Figure 2:
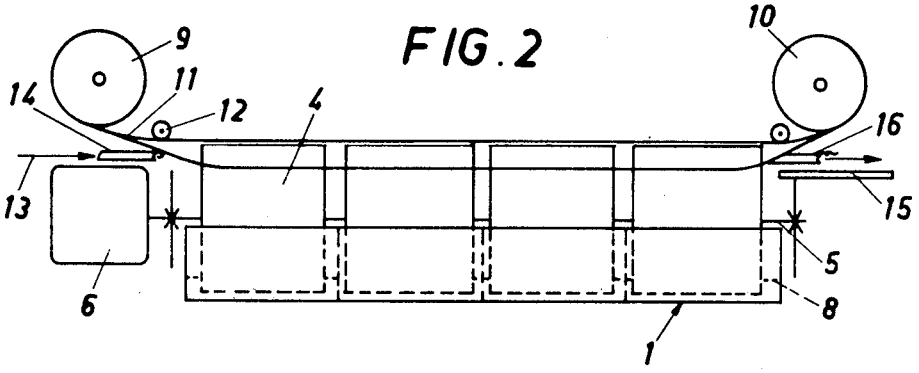
FIG. 2 shows in a schemation side view one embodiment of the development machine according to the invention.

FIG. 2 shows a first embodiment of the machine according to the invention in a side elevation and as can be seen the cylinders 4 are immersed only partly in the liquid in each receptacle, said liquid having a level 8. The different process liquids in the receptacles can be varied in relation to the objects to be developed and if it concerns colour or monochrome prints. Thus, the first two receptacles can contain different developing liquids, the third receptacle can contain a fixing liquid whereas the last receptacle ordinarily contains rinsing water. All these liquids must, for obtaining a satisfactory development result, be maintained at a certain temperature which must be uniform through the liquid volume in each receptacle, and this can easily be brought about with use of different types of heating and/or cooling devices which are located e.g. in the bottom of each receptacle. As the liquid quantity is comparatively small in each receptacle it is ascertained that the energy requirement for the temperature adjustment will be low. Between the adjacent receptacles can be arranged devices which prevent mixing of the liquids, e.g. drops of liquid from a receptacle with development liquid to a receptacle with a fixing solution, and these devices can be designed as scrapers fitted at the rear end of each cylinder, as air curtains or shower devices between the receptacles. Such devices are not shown in the drawings.

Figure 3:
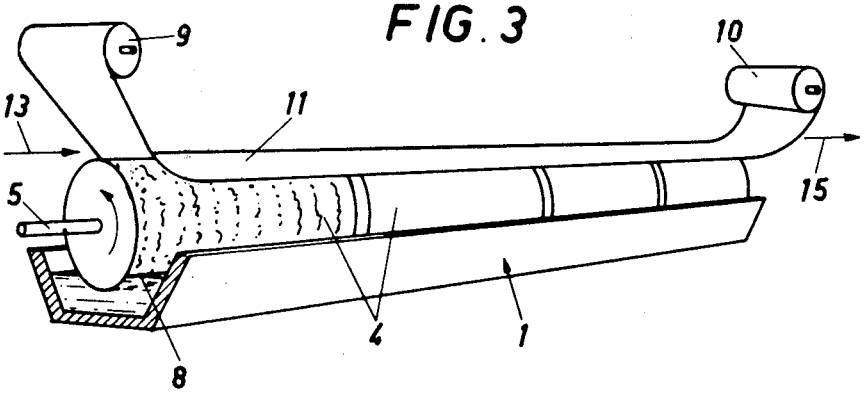
FIG. 3 is a schematic perspective view of the embodiment according to FIG. 2 of the development machine according to the invention shown partly in section.

FIGS. 2 and 3 further show that the apparatus incorporates a transport device which in this embodiment comprises two rollers 9, 10 arranged one at each short side of the tank 1 and which rollers support a conveyor track 11 running thereover in the longitudinal direction of the cylinders. The conveyor track 11 can be a belt which is comparatively flexible laterally, and which belt by means of guiding rollers 12, of which only two are shown, can adapt itself to the curvature of the cylinders 4 and to engage a portion of the upper part of the cylinders situated above the liquid level 8 in the receptacles along a path located mainly diametrically opposite the part of the cylinders which are immersed in the liquids. The transport device is shown as a track which can be wound off the roller 9 and wound up on the roller 10, but it is to be understood that the belt 11 can instead be made continuous whereby it travels back from the roller 10 to the roller 9 above the cylinders in a closed track. As shown in the left hand part of the figures there is indicated a device at 13, by aid of which the pictures 14, which shall be developed, are fed in between the envelope surface of the first cylinder 4 and the conveyor belt 11. The conveyor belt 11 is preferably prepared in such a manner that the surface of the photographic paper turned from the picture surface will adhere to the transport belt and thereby will follow this during its movement along the cylinders 4. The conveyor belt 11 can for this purpose be prepared with an adhesive or it can alternatively be provided e.g. with suction conduits which are able to suck the paper against the conveyor belt. The transport device 9, 10, 11 can be designed otherwise than as a conveyor belt and the main thing is that the transport device has the ability to move the photographic paper along the rotating cylinders. At the end of the machine—the right hand side in the figures—there is arranged a feeding-out station 15, wherein the developed picture 16 can be fed out and dried. In FIG. 3 is shown very schematically in a perspective view a portion of the machine shown in FIG. 2, whereby one end wall of the tank 1 and the driving device 6 have been removed.

Figure 4:
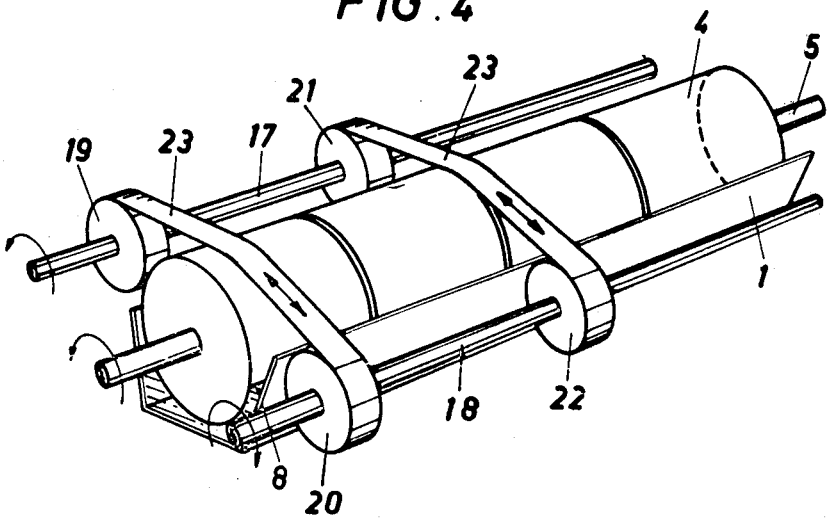
FIG. 4 shows in a perspective view a second embodiment of the development machine having a modified means for transferring the pictures.

In FIG. 4 is shown in a schematic perspective view a modified embodiment of the development machine according to the invention.

This embodiment incorporates like the embodiment described hereabove a tank 1, which is subdivided in a number of receptacles 2 for process liquids, rotatable cylinders immersed in the liquid in the receptacles and driving devices (not shown) for rotating the cylinders. The transport device is however in this embodiment designed as two side shafts 17, 18 which are parallel with the cylinder shaft 5. The side shafts 17, 18 are arranged one at each longitudinal side of the tank 1 and they are each intended to carry pairs of spools 19, 20; 21, 22, which are aligned two and two and which are intended to contain photographic reel paper, which is to be wound between the two spools 19, 20; 21, 22 in each pair of spools, whereby the spools are arranged at such a level relative to the cylinder shaft 5 that the photographic paper track 23 will engage a curved envelope surface of the associated cylinder situated above the liquid level 8 in the tank. The cylinders are at the same time rotated in a manner described hereabove, whereby a liquid film will be carried along with the cylinder, and the paper track 23 with its emulsion surface will at its engagement against the cylinder envelope surface always contact one of the process liquids.

Both spool shafts 17, 18 can be individually driven and disconnected for allowing winding of the paper track in both directions. The spools 19, 20; 21, 22 are furthermore axially displaceable along the spool shafts, whereby they can be moved between the different receptacles and the paper track can thereby be brought in contact with the different liquids. The spools 19, 20; 21, 22 can preferably be rotated with but be axially displaceable on the spool shafts 17, 18 via splines or the like. The spool shafts are furthermore preferably mounted in such a manner that they can be retracted from the tank, whereby the machine can be used for sheet film with a transport device according to that shown in FIGS. 2 and 3. By use of the embodiment of the machine shown in FIG. 4 it is possible simultaneously to develop several objects, whereby a series of pairs of spools are arranged on the side shafts. The axial movement of the spools can also be arranged to be effected automatically by means of guiding means (not shown).

Figure 5:
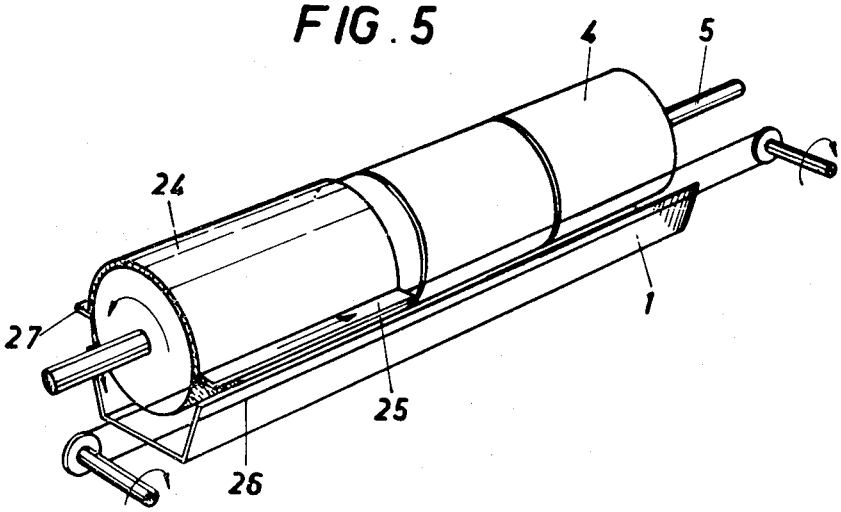
FIG. 5 shows a third embodiment with further modified picture transferring means.

In FIG. 5 is finally shown another embodiment of the invention with a further modified transport device for movement of the paper whereby again the machine incorporates a plurality of receptacles in a tank 1 and a cylinder 4 arranged in each receptacle. The transport device is in this case intended particularly for big sheets of photographic paper, whereby one side edge of the sheet 24 is fitted to a runner 25, which is arranged parallel to the cylinder shaft. The runner 25 is adapted to be transferred in the longitudinal direction of the machine, e.g. by a rope or chain drive 26, whereby the sheet is placed over the cylinder surface and it is on the side of the cylinder opposite from the runner provided with weights 27 or it is fitted to a guiding which will ascertain that its edge will engage the cylinder envelope surface. The runner 25 is located in relation to the cylinder so that the cylinders' rotation will pull the sheet 24 in a direction from the runner 25 and against the weights 27 or the guiding or the like. The cylinder will thereby in addition to its liquid carrying function also assure that the paper 24 will lay close to the cylinder envelope surface.

The transport device is designed in such manner that the transport speed for the pictures to be developed can be varied. By adjusting the speed and e.g. by altering the lengths of the cylinders and the receptacles respectively it is possible to modify a machine to a very high extent in a relatively simple manner to any desired time of contact with the different liquids used in the development process. It is in the embodiment shown in FIGS. 2 and 3 also possible to make the process time in a specific receptacle shorter without altering its length by using special guiding rollers which are not shown and which bring the conveyor belt to rise from the surface of the cylinder in question before the end edge of this cylinder. The cylinders 4 are preferably along their envelope surfaces provided with embossments or the like, which will increase the ability of the cylinders during rotation to carry liquid to their upper surface where the pictures which are conveyed by the transport device will contact the liquid layer. Due to the fact that the pictures all the time are moved with their emulsion surface in contact with the liquid layer whereas the opposite surface of the photographic paper will be turned therefrom and therefore will not be wet by the process liquids, a smaller liquid consumption occurs at the same time as a shorter drying time of the developed picture is obtained.

The machine according to the invention provides a simple and efficient development unit with the aid of which the necessary liquid quantities can be limited at the same time as a machine is obtained, which is easily cleaned and which furthermore requires only little space.

The machine according to the invention can easily be provided with paper transfer means as described in all the three described embodiments, whereby the machine can be used for reel paper, for small sheets and for big sheets.

The embodiments of the development machine as shown in and described in connection to the accompanying drawings is not to be considered as limiting the scope of the application but modifications and amendments are possible within the scope of the appended claims.

I claim:

1. In a machine for developing picture material of the type wherein a cylindrical member is rotatably mounted on a drive shaft, means are provided to produce a liquid film on the outer surface of the cylindrical member, and further means are provided for positioning the picture material in contacting engagement with the liquid film on the outer surface of the cylindrical member, the improvement comprising an elongated tank, partition means to subdivide said tank in the longitudinal direction into a plurality of receptacles for different process liquids, a cylindrical member partially immersed in the liquid in each tank and rotatably mounted on a driven shaft about a substantially horizontal axis so that rotation of said cylindrical member produces a liquid film on the outer surface thereof, said cylindrical members being coaxially aligned in a continuous row, and conveying means for conveying the picture material into contacting engagement with said liquid film surface on said cylindrical members comprising two driven elongated conveyor shafts rotatably mounted adjacent the outer surface of said cylindrical members with their longitudinal axes of rotation in parallel with the rotational axis of said cylindrical member, picture material mounting means on said conveyor shafts to mount said picture material in continuous strip form so that said picture material can be transferred between said mounting means with one surface thereof in contacting engagement with said liquid film surface on a cylindrical member, and said mounting means being movable axially along said conveyor shafts so that said strip-form picture material can be transferred from one cylindrical member to another to successively treat it with said different process liquids in said receptacles.

2. A machine as claimed in claim 1 wherein said picture material mounting means comprises spool members adapted to receive said strip-form picture material.

3. A machine as claimed in claim 2 wherein means are provided for releasably driving said conveyor shafts to facilitate winding and unwinding said strip-form picture material on said spool members, and said spool members are axially displaceably mounted on said conveyor shafts.

* * * * *